US011200872B2

(12) United States Patent
Davey et al.

(10) Patent No.: US 11,200,872 B2
(45) Date of Patent: Dec. 14, 2021

(54) TRANSDUCER APPARATUS FOR AN EDGE-BLOWN AEROPHONE AND AN EDGE-BLOWN AEROPHONE HAVING THE TRANSDUCER APPARATUS

(71) Applicant: AUDIO INVENTIONS LIMITED, Farnborough (GB)

(72) Inventors: Paul Davey, Farnborough (GB); Brian Smith, Farnborough (GB)

(73) Assignee: AUDIO INVENTIONS LIMITED, Farnborough (GB)

( * ) Notice: Subject to any disclaimer, the term of this patent is extended or adjusted under 35 U.S.C. 154(b) by 158 days.

(21) Appl. No.: 16/480,902

(22) PCT Filed: Jan. 25, 2018

(86) PCT No.: PCT/GB2018/050209
§ 371 (c)(1),
(2) Date: Jul. 25, 2019

(87) PCT Pub. No.: WO2018/138501
PCT Pub. Date: Aug. 2, 2018

(65) Prior Publication Data

US 2020/0357367 A1 Nov. 12, 2020

(30) Foreign Application Priority Data

Jan. 25, 2017 (GB) ..... 1701267

(51) Int. Cl.
*G10D 7/026* (2020.01)
*G10H 3/22* (2006.01)
*G10H 7/10* (2006.01)

(52) U.S. Cl.
CPC ..... *G10D 7/026* (2013.01); *G10H 3/22* (2013.01); *G10H 7/105* (2013.01); *G10H 2220/005* (2013.01)

(58) Field of Classification Search
CPC ..... G10D 7/026; G10H 3/22; G10H 7/105; G10H 2220/005
See application file for complete search history.

(56) References Cited

U.S. PATENT DOCUMENTS 2,138,500 A 11/1938 Miessner
3,429,976 A 2/1969 Tomcik
(Continued)

FOREIGN PATENT DOCUMENTS

CN 104810012 A 7/2015
DE 3839230 A1 5/1990
(Continued)

OTHER PUBLICATIONS

Gibiat et al., "Acoustical Impedance Measurements by the Two-Microphone-Three-Calibration (TMTC) Method", The Journal of the Acoustical Society of America, American Institute of Physics for The Acoustical Society of America, New York, NY, US, vol. 88, No. 6, Dec. 1990, pp. 2533-2545.

*Primary Examiner* — Jianchun Qin
(74) *Attorney, Agent, or Firm* — Jason P. Mueller; FisherBroyles, LLP

(57) ABSTRACT

This disclosure provides a transducer apparatus for an edge-blown aerophone, the edge-blown aerophone having an aerophone embouchure hole. An aerophone speaker delivers sound to a resonant chamber of the aerophone via the aerophone embouchure hole. An aerophone microphone receives, via the aerophone embouchure hole, sound in the resonant chamber. A housing provides a lip plate with a housing embouchure hole independent and separate from the aerophone embouchure hole. Breath sensors sense breath applied across the housing embouchure hole. An electronic processor, connected to the speaker, receives signals from the microphone and the breath sensors. The breath sensors provide signals indicative of breath strength. The electronic
(Continued)

Figure 1:
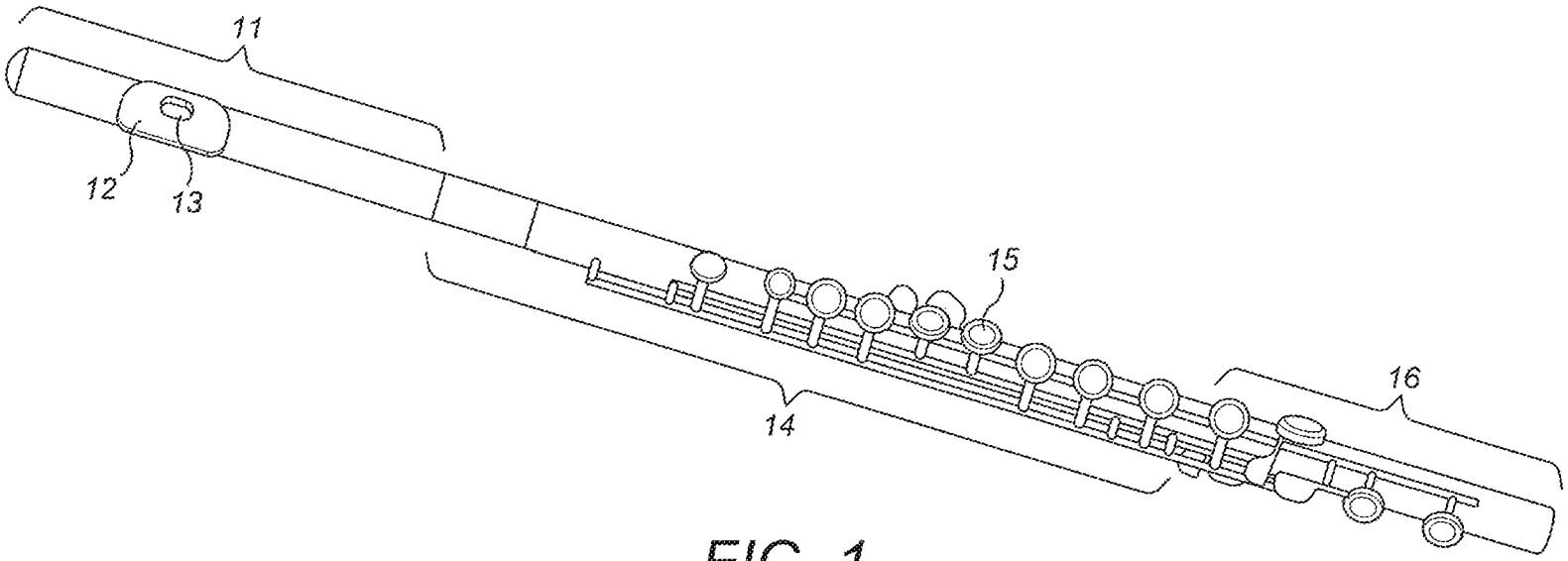

processor generates an excitation signal which is delivered as an acoustic excitation signal to the resonant chamber by the aerophone speaker. The electronic processor uses the signals it receives to determine a desired musical note which a player of the aerophone wishes to play.

24 Claims, 4 Drawing Sheets

(56) References Cited

U.S. PATENT DOCUMENTS

| | | | | |
|---|---|---|---|---|
| 3,558,795 | A | 1/1971 | Barcus et al. | |
| 3,571,480 | A | 3/1971 | Tichenor et al. | |
| 4,038,895 | A * | 8/1977 | Clement | G10H 5/002 84/687 |
| 4,233,877 | A | 11/1980 | Okami | |
| 5,131,310 | A * | 7/1992 | Kunimoto | G10H 5/007 84/604 |
| 5,245,130 | A | 9/1993 | Wheaton | |
| 5,668,340 | A | 9/1997 | Hashizume | |
| 5,929,361 | A | 7/1999 | Tanaka | |
| 7,220,903 | B1 | 5/2007 | Bronen | |
| 9,417,217 | B2 | 8/2016 | Nikolovski | |
| 10,170,091 | B1 | 1/2019 | Tabata | |
| 10,229,663 | B2 | 3/2019 | Smith et al. | |
| 10,347,222 | B2 | 7/2019 | Sasaki | |
| 10,475,431 | B2 | 11/2019 | Smith et al. | |
| 2006/0027074 | A1 | 2/2006 | Masuda et al. | |
| 2007/0068372 | A1* | 3/2007 | Masuda | G10H 1/0008 84/723 |
| 2007/0144336 | A1* | 6/2007 | Fujii | G10H 3/24 84/723 |
| 2012/0230155 | A1 | 9/2012 | Kawaguchi | |
| 2014/0224100 | A1* | 8/2014 | Vassilev | G10H 5/007 84/723 |
| 2014/0256218 | A1 | 9/2014 | Kasdas | |
| 2015/0101477 | A1 | 4/2015 | Park et al. | |
| 2018/0090120 | A1 | 3/2018 | Kasuga | |
| 2018/0137848 | A1 | 5/2018 | Souvestre | |
| 2018/0218720 | A1 | 8/2018 | Smith et al. | |
| 2018/0268791 | A1 | 9/2018 | Okuda et al. | |
| 2019/0156808 | A1 | 5/2019 | Smith et al. | |
| 2020/0005752 | A1 | 1/2020 | Davey et al. | |

FOREIGN PATENT DOCUMENTS

| | | | |
|---|---|---|---|
| EP | 1585107 | A2 | 10/2005 |
| EP | 1760690 | A2 | 3/2007 |
| EP | 1804236 | A1 | 7/2007 |
| EP | 2650870 | A1 | 10/2013 |
| FR | 2775823 | A1 | 9/1999 |
| GB | 2537104 | A | 10/2016 |
| GB | 2559135 | A | 8/2018 |
| GB | 2559144 | A | 8/2018 |
| JP | 2002278556 | A | 9/2002 |
| JP | 2005122099 | A | 5/2005 |
| JP | 2007065197 | A | 3/2007 |
| JP | 2008076838 | A | 4/2008 |
| JP | 2011154151 | A | 8/2011 |
| JP | 2013164542 | A | 8/2013 |
| JP | 2014232153 | A | 12/2014 |
| WO | 2018138501 | A1 | 8/2018 |
| WO | 2018138504 | A1 | 8/2018 |

* cited by examiner

TRANSDUCER APPARATUS FOR AN EDGE-BLOWN AEROPHONE AND AN EDGE-BLOWN AEROPHONE HAVING THE TRANSDUCER APPARATUS

CROSS-REFERENCE TO RELATED APPLICATIONS

This application is a national stage entry under 35 U.S.C. 371 of PCT Patent Application No. PCT/GB2018/050209, filed Jan. 25, 2018, which claims priority to United Kingdom Patent Application No. 1701267.5, filed Jan. 25, 2017, the entire contents of each of which are incorporated herein by reference.

This disclosure relates to a transducer apparatus for an edge-blown aerophone and to an edge-blown aerophone having the transducer apparatus. Edge-blown aerophones include side-blown aerophones such as western concert flutes and piccolos and end-blown aerophones such as ney, xiao, kaval, danso. Edge-blown aerophones can also include ducted flutes or fipple flutes such as flageolets and recorders. The edge-blown aerophones do not require a reed. They can be open at one end or both.

Musicians are sometimes constricted on where and when they can practice. Being able to practice an instrument in a "silent" mode, in which the instrument is played without making a noise audible to those in the immediate vicinity, can be advantageous. At other times, the musician playing e.g. a flute may wish to have the music played amplified to be heard even more clearly or by a large audience.

The notes on a flute are selected by the player opening and closing holes in the body of the instrument using the fingers. The more holes that are closed, the longer the effective length of the tube and the lower the frequency of the standing wave that is produced when the air in the instrument is set in vibration by the player. For a flute and other edge-blown aerophones the vibration comes from the air turbulence that is created by the player blowing into/over an opening into the instrument rather than any vibration of the lips. Unlike a reed instrument such as a clarinet or saxophone, the flute and other edge-blown instruments do not have an "octave-key" or "register-key" to allow the player to select a higher harmonic of the fingered note and thus access a greater range of notes. On such instruments the player selects the higher harmonics by changing the direction and speed of the air jet.

JP2011154151 provides a modified flute which has sensors attached to all of the keys of the flute and also a microphone located in the head joint of the flute. A signal from the key switchers and the microphone are processed in a CPU and then sound is output via a speaker. In the main embodiment the breath sensor is mounted externally on the instrument next to the embouchure hole of the instrument to detect the breath pressure of a breath blown by the player of the instrument. This signal will also be used by the CPU.

This disclosure provides a transducer apparatus according to claim 1 or claim 10 or claim 13 or claim 14.

This disclosure also provides an edge-blown aerophone as claimed in claim 21.

This disclosure further provides apparatus as claimed in claim 22 or claim 23 comprising a transducer apparatus in combination with computer apparatus and/or a smartphone.

An embodiment of the disclosure is described with reference to the accompanying figures in which:

FIG. 1 is a view of a western concert flute, illustrating the parts of the flute.

Figure 2A:
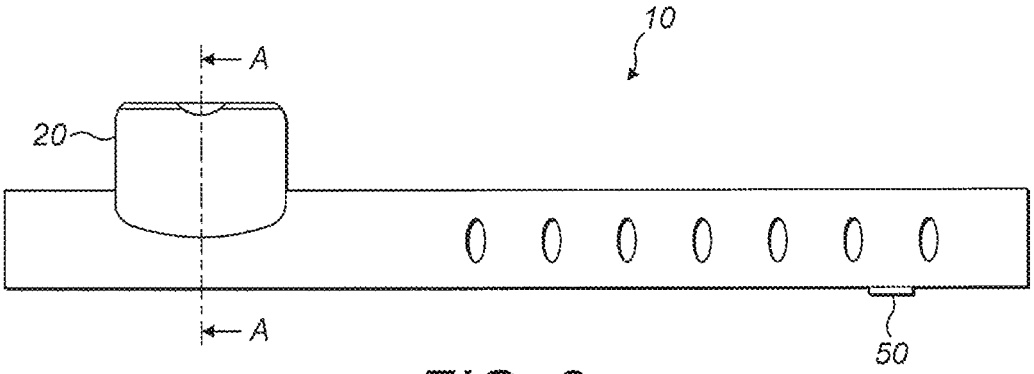
Figure 2B:
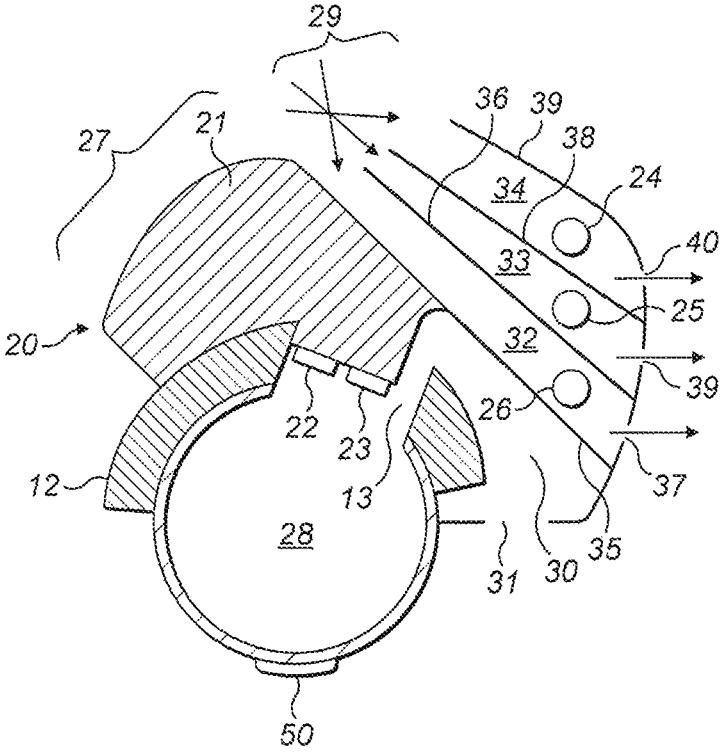
Figure 3:
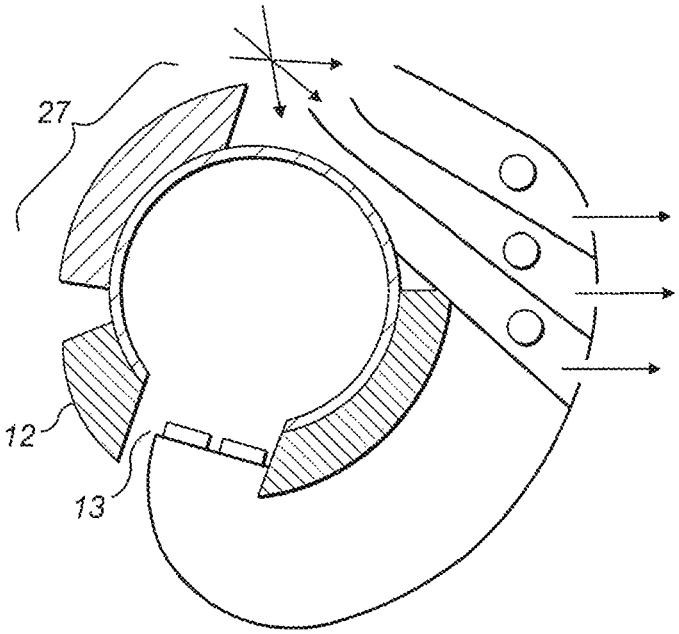
Figure 4:
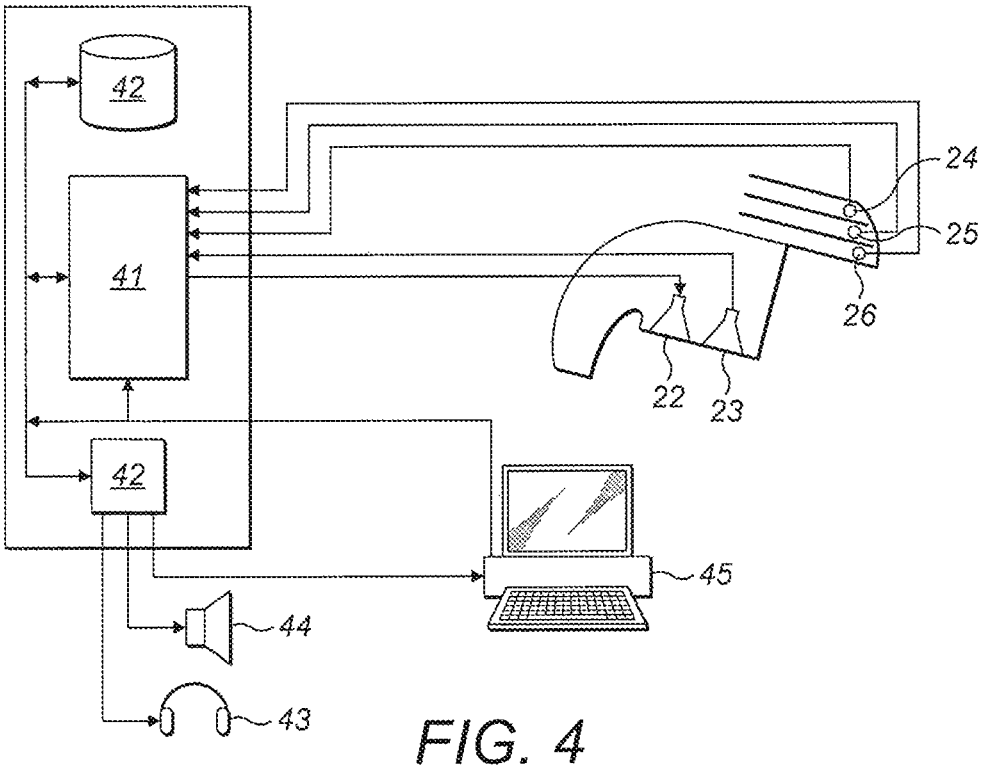
Figure 5:
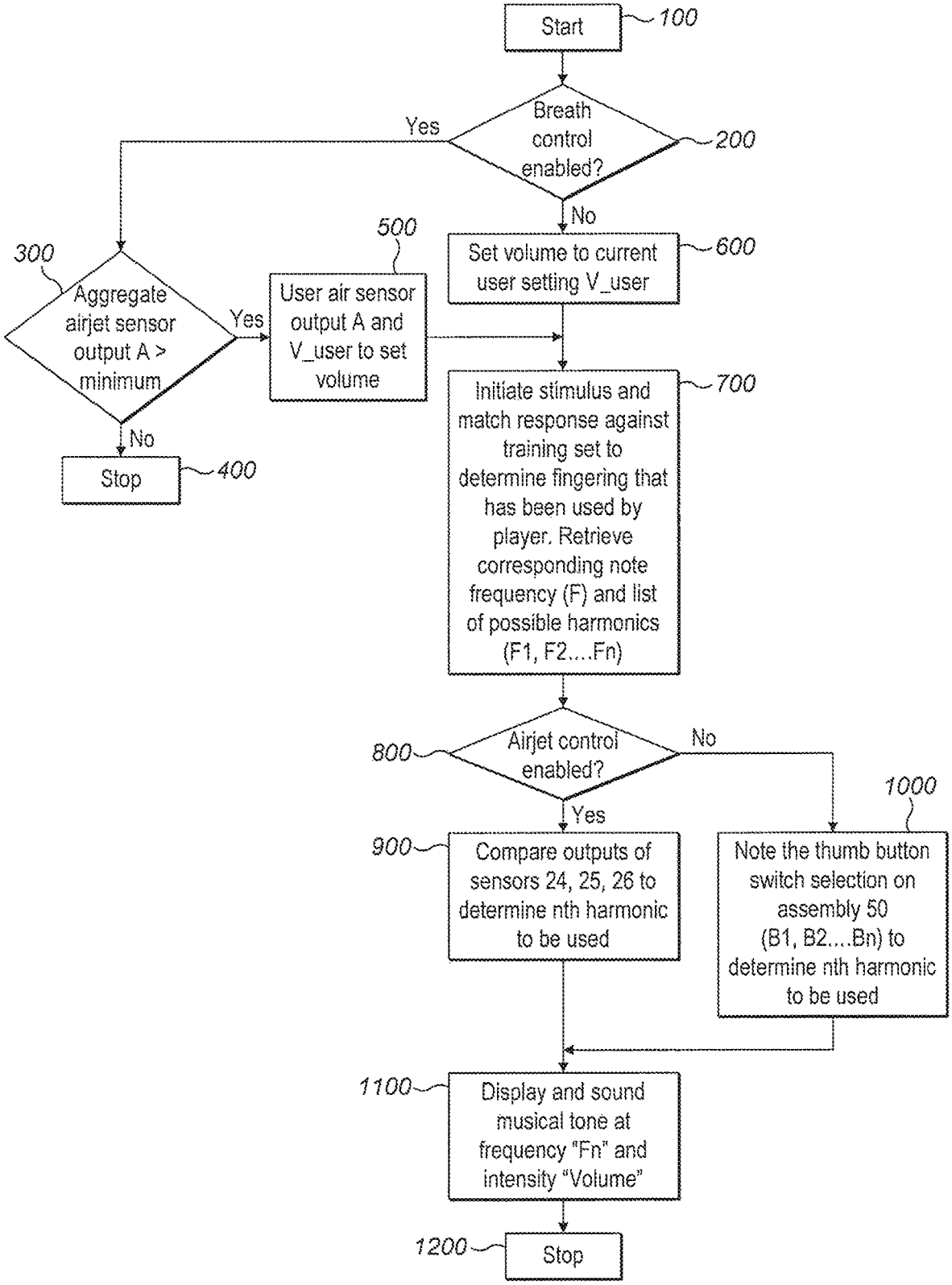

FIG. 2*a* is a schematic view of the FIG. 1 flute having mounted on it a transducer apparatus according to the disclosure;

FIG. 2*b* is a cross section through the apparatus of FIG. 2*a*, taken along the line A-A' shown in FIG. 2*a*, in the direction of the arrow of the figure;

FIG. 3 is a view of a second embodiment of a transducer apparatus according to the disclosure;

FIG. 4 is a circuit diagram illustrating the functioning of the electronics of the transducer apparatus; and FIG. 5 is a flow chart illustrating a method of operation of the transducer apparatus In FIG. 1 there can be seen a western concert flute 10 having a head joint 11, a lip plate 12, an embouchure hole 13, a body 14, keys 15 and a foot joint 16. The body 14 is sometimes called a middle joint.

An embodiment of the disclosure is shown in FIGS. 2*a* and 2*b*. FIG. 2*a* shows a schematic representation of the flute 10 shown in FIG. 1. This is a "standard" western concert flute. Mounted on the flute 10 is a transducer apparatus 20. This apparatus is detachably mounted on the flute 10, e.g. by using a strap (not shown). The transducer apparatus 20 includes a housing 21 having located therein electronics, which are shown schematically in the circuit diagram of FIG. 4, and supports a speaker 22 and a microphone 23 and an array of sensors 24, 25 and 26, which will be described in more detail later.

As can be seen in FIG. 2*b*, the housing 20 is configured to extend part the way around the head joint 11 of the flute 10, over the lip plate 12, which is also shown in the figure. The housing 21 provides a surface 27 (see FIG. 2*b*) which acts as a "false" lip plate. The housing 21 positions the speaker 22 and the microphone 23 in or adjacent to the embouchure hole 13, in order to be exposed to a resonant chamber 28 within the flute 10. The housing 20 defines an aperture 29 which acts as a "false" embouchure hole 13. The housing 20 and the microphone 23 and speaker 22 do not completely close the embouchure hole 13 and the housing 20 is provided with an embouchure passage 30 connecting the embouchure hole 13 to an aperture 31 in the housing 20 whereby the embouchure hole 13 is connected to atmosphere.

The housing 20 has provided in it three sensor passages 32, 33 and 34. The sensor passage 32 is divided from the embouchure passage 30 by a dividing wall 35 and is divided from sensor passage 33 by a dividing wall 36. At one end the sensor passage 32 is open to the false embouchure hole 29. At the other end of the sensor passage 32 an aperture 37 is provided to allow air to pass from the sensor passage 32. The sensor 26 is located in the sensor passage 32 near the end of the passage where the aperture 37 is provided. The sensor 26 could be a pressure sensor sensing air pressure within the sensor passage 32. Alternatively, the sensor 26 could include a finned wheel, akin to a water wheel, half of which would be covered and half of which would be open to air passing through the passage 32, with the wheel then spun by air passing through the passage 32 at a rate which indicates the rate of air through the passage 32. The sensor 26 could be a vibrating reed whose vibration could be sensed by piezoelectric devices, Hall Effect sensors, magnetic sensors or a light sensor incorporating, for instance, an LED. The sensor 26 could include a vibrating string with an electrical pickup (akin to an electric guitar). The sensor 26 could include a fine wire thermocouple which is heated electrically and then cooled by flow of air across it; this is fast-acting, low power and easy to implement. The sensor 26 could include a moving baffle supported by a hair or compression spring, whose movement is detected as a way of sensing pressure. The sensor 26 could include a miniature pitot tube with associated electronics. The sensor 26 could include a miniature windmill provided with a rotary position sensor. The sensors 24 and 25 will usually be identical to the sensor 26.

The sensor passage 33 is defined between the dividing wall 36 and a dividing wall 38 which separates the sensor passage 33 from the sensor passage 34. The sensor passage 33 is open at one end to the false embouchure hole 29. At the other end of the sensor passage 33 an aperture 29 is provided to allow flow of air from the sensor passage 33. The sensor 25 is provided in the sensor passage 33 near the end with the aperture 29.

The sensor passage 34 is defined between a dividing wall 38 and an external wall 39 of the housing 20. The sensor passage 34 is open at one end to the false embouchure hole 29. At the other end the sensor passage 34 is provided with an aperture 40 provided in the housing to allow air to flow from the sensor passage 34. The sensor 24 is provided in the sensor passage 33 near the end with the aperture 29.

The microphone 23 and speaker 24 point into the embouchure hole 13, but they and the housing 21 do not seal the hole 13. For a flute to operate as designed the embouchure hole 13 should not be completely sealed; when a flautist plays they leave about half of the hole 13 uncovered. Accordingly a gap is left by the housing 21 next to the microphone 23 and speaker 24.

In use of the transducer apparatus a flautist blows across the false embouchure hole 29. The flautist's breath passes along the sensor passages 32, 33, 34 and the array of sensors 24, 25 and 26 in the passages 32, 33, 34 allow detection of the direction and strength of the air jet.

Turning now to FIG. 4 an electronic processor 41 produces an excitation signal injected by the loudspeaker 22 as an acoustic signal into the mouthpiece via the embouchure hole 13. The sound in the resonant chamber 28 is measured by the co-located microphone 23. As described below, a logarithmic chirp can be used as an excitation signal. As mentioned above, for a flute to operate as designed the embouchure hole should not be completely sealed as it is with the clarinet or sax; when a flautist plays they leave about half of the hole uncovered. Accordingly a gap is left next to the microphone 22 and speaker 23, the gap connected to atmosphere via the passage 30.

In order to play in higher octaves a flute player picks out the harmonics by varying the direction and intensity of the air jet. The sensors 24, 25, 26 allow measurement of air velocity in three different directions and this allows sensing of the breath variations of a flautist.

In use the transducer apparatus 20 will be mounted on the head joint 11 of the flute place of a reed. The flautist will then blow through the inlet 29 while manually operating keys 15 of the flute 10 to open and close tone holes of the instrument and thereby select a note to be played by the instrument. The blowing through the inlet 29 will be detected by the sensors 24, 25 and 26, which will send pressure signals to the processor 41. The processor 41 in response to the pressure signals will output an excitation signal to the speaker 22, which will then output sound to the resonant chamber 28. The frequency and/or amplitude of the excitation signal is varied having regard to the pressure signals output by the sensors 24,25 and 26, so as to take account of how hard and the direction in which the player is blowing. The frequency and/or amplitude of the excitation signal can also be varied having regard to an ambient noise signal output by an ambient noise microphone (not shown in the figures) separate and independent of the microphone 23, which measures the ambient noise outside the resonant chamber 28, e.g. to make sure that the level of sound output by the speaker 22 is at least greater than a pre-programmed minimum above the level of the ambient noise.

The microphone 23 will receive sound in the resonant chamber 28 and output a measurement signal to the processor 41. The processor 41 will compare the measurement signal or a spectrum thereof with pre-stored signals or pre-stored spectra, stored in a memory device 42, to find a best match (this could be done after removing from the measurement signal the ambient noise indicated by the ambient noise signal provided by the ambient noise microphone). Each of the pre-stored signals or spectra will correspond with a musical note. By finding a best match of the measurement signal or a spectrum thereof with the pre-stored signals or spectra the processing device thereby determines the musical note played.

The processor 41 incorporates a synthesizer which synthesizes an output signal representing the detected musical note. This synthesized musical note is output by an output device 42, e.g. a wireless transmitter, to wireless headphones 43, so that the player can hear the synthesized note output by the headphones, and/or to a speaker 44 and/or to a personal computer or laptop 45 or to a smartphone. The output device 42 could provide a frequency modulated infra-red LED signal to be received by commercially available infra-red signal receiving headphones 43; the use of such FM optical transmission advantageously reduces transmission delays.

The processor will use the signals from the sensors 24,25,26 in the process of detecting what musical note has been selected and/or what musical note signal is synthesized and output, since the sensor signals will indicate the strength of and direction of breath of the flautist and hence the pitch and strength of the musical note desired. Also the signals from sensors 24, 25 and 26 may be used to modulate the synthesized sounds, e.g. to recognize when the player is applying a vibrato breath and in response import a vibrato into the synthesized sounds.

The transducer apparatus as described above has the following advantages:

i) It is a device easily capable of being fitted to and removed from a mouthpiece of a standard instrument or could be permanently fitted to a spare (inexpensive) mouthpiece.

ii) It has integral sensors which allow selection of the excitation signal output by the speaker and also allow control of when a synthesized musical note is output.

iii) It has integral embedded signal processing and wireless signal output.

iv) It allows communication of data to a laptop, tablet or personal computer/computer tablet/smart-phone application, with can run software providing a graphical user interface, including a visual display on a screen of live musical note spectra.

v) It can be provided optionally with a player operated integral excitation volume control.

vi) It can be provided with an ambient noise sensing microphone which allows integral ambient noise cancellation from the air chamber microphone measurement signal. It may be advantageous to have the ambient noise microphone as close to the instrument as possible to give an accurate ambient noise reading vii) Its processor 41 includes an integral synthesizer providing a synthesized musical note output for aural feedback to the player.

viii) It includes and is powered by an internal battery and so does not requires leads connected to the device which might inhibit the mobility of the player of the reed instrument.

ix) It advantageously processes the microphone signal in electronics mounted on the reed instrument and hence close to microphone to keep low any latency in the system and to minimize data transmission costs and losses.

The invention as described in the embodiment above introduces an electronic stimulus generated by a small speaker 22 built in the transducer apparatus 20. The stimulus is chosen such that the resonance produced by depressing any combination of key(s) causes the acoustic waveform, as picked up by the small microphone 23, placed close to the stimulus provided by the speaker 22, to change. Therefore analysis of the acoustic waveform, when converted into an electric measurement signal by microphone 23, and/or derivatives of the signal, allows the identification of the intended note associated with the played key positions. The stimulus provided via the speaker 22 can be provided with very little energy and yet with appropriate processing of the measurement signal, the intended note can still be recognized. This can provide to the player of the reed instrument the effect of playing a near-silent instrument.

The identification of the intended notes gives rise to the synthesis of a musical note, typically, but not necessarily, chosen to mimic the type of instrument played. The synthesized sound will be relayed to headphones or other electronic interfaces such that a synthetic acoustic representation of the notes played by the instrument is heard by the player. Electronic processing can provide this feedback to the player in close to real-time, such that the instrument can be played in a natural way without undue latencies. Thus the player can practice the instrument very quietly without disturbing others within earshot.

The electronic processor 41 can use one or more of a variety of well-known techniques for analyzing the measurement signal in order to discover a transfer function of the resonant chamber 28 and thereby the intended note, working either in the time domain or the frequency domain. These techniques include application of maximum length sequences either on an individual or repetitive basis, time-domain reflectometry, swept sine analysis, chirp analysis, and mixed sine analysis.

In one embodiment the stimulus signal sent to the speaker 22 will be a stimulus-frame including tone fragments chosen for each of the possible musical notes of the instrument. The tones can be applied discretely or contiguously following on from each other. Each of the tone fragments may be including more than one frequency component. The tone fragments are arranged in a known order to generate the stimulus-frame. The stimulus-frame is applied as an excitation to the speaker, typically being initiated by the player blowing into the instrument. A signal comprising a version of the stimulus-frame as modified by the acoustic transfer function of the resonant chamber (as set by any played keys and resonances generated thereby) is picked up by the microphone 23. The time-domain measurement signal is processed, e.g. by a filter bank or fast Fourier transform (fft), to provide a set of measurements at known frequencies. The frequency measures allow recognition of the played note, either by comparison with pre-stored frequency measurements of played notes or by comparison with stored frequency measurements obtained via machine learning techniques. Knowledge of ordering and timing within the stimulus-frame may be used to assist in the recognition process.

The stimulus-frame typically is applied repetitively on a round-robin basis for the period that air-pressure is maintained by the player (as sensed by the sensors 24, 25, 26). The application of the stimulus frame will be stopped when the sensors 24,25,26 give signals indicating that the player has stopped blowing and the application of the stimulus frame will be re-started upon detection of a newly timed note as indicated by the sensors 24,25,26. The timing of a played note output signal, output by the processor 41, on identification of a played note, is determined by a combination of the recognition of the played note and the measured air-pressure and the breath direction as indicated by the differences between the signals provided by the sensors 24, 25, and 26. The played note output signal is then input to synthesis software run on the processor 41 such that a mimic of the played note is output to the player typically for instance via wireless headphones.

It is desirable to provide the player with low-latency feedback of the played note, especially for low frequency notes where a single cycle of the fundamental frequency may take tens of milliseconds. A combination of electronic processing techniques may be applied to detect such notes with low latency by applying a tone or tones at different frequencies to the fundamental such that the played note may still be detected from the response.

In one embodiment the excitation signal sent to the speaker 22 is an exponential chirp. This signal excites the resonant chamber of the reed instrument via the loudspeaker on a repetitive basis, thus forming a stimulus-frame. The starting frequency of the scan is chosen to be below the lowest fundamental (first harmonic) of the instrument.

The sound present in the resonant chamber 28 is sensed by the microphone 23 and assembled into a frame of data lasting exactly the same length as the exponential chirp excitation signal (which provides the stimulus-frame). Thus the frames of microphone data and the chirp are synchronized. An FFT is performed upon the frame of data in the measurement signal provided by the microphone 23 and a magnitude spectrum is thereby generated in a standard way. The spectrum is compared by the processor 41 with spectra stored in the memory 42 to determine a best match and hence the played note identified.

The transducer apparatus can have a training mode in which the player successively plays all the notes of the instrument and the resultant magnitude spectra of the measurement signals provided by the microphone are stored correlated to the notes being played. The transducer apparatus 20 is provided with a signal receiver as well as its signal transmitter and thereby communicates with a laptop, tablet or personal computer or a smartphone running application software that allows player control of the transducer apparatus. The application software allows the player to select the training mode of the transducer apparatus 20. Typically the memory device 42 of the apparatus will allow three different sets of musical note data to be stored. The player will select a set and then will select a musical note for storing in the set. The player will manually operate the relevant keys of the instrument to play the relevant musical note and will then use the application software to initiate recording of the measurement signal from the microphone 23. The transducer apparatus will then cycle through a plurality of cycles of generation of an excitation signal and will average the measurement signals obtained over these cycles to obtain a good reference response for the relevant musical note. The process is then repeated for each musical note played by the instrument. When all musical notes have been played and reference spectra stored, then the processor 41 has a set of stored spectra in memory 42 which include a training set. Several (e.g. three) training sets may be generated (e.g. for different instruments), for later selection by the player. The laptop, tablet or personal computer or smartphone 45 may have a screen and will display a graphical representation of each played musical note as indicated by the measurement signal. This will allow a review of the stored spectra and a repeat of the learning process of the training mode if any defective musical note data is seen by the player.

Rather than use application software on a separate laptop, tablet or personal computer 45 or smartphone, the software could be run by the electronic processor 41 of the transducer apparatus 20 itself and manually operable controls, e.g. buttons, provided on the transducer apparatus 20, along with a small visual display, e.g. LEDs, that provides an indication of the selected operating mode of the apparatus 20, musical note selected and data set selected.

An accelerometer (not shown) could be provided in the transducer apparatus 20 to sense motion of the transducer apparatus 20 and then the player could move the instrument to select the input of the next musical note in the training mode, thus removing any need for the player to remove his/her from the instrument between playing of musical notes. Alternatively, the electronic processor 41 or a laptop, tablet or personal computer 45 or smartphone in communication therewith could be arranged to recognize a voice command such as 'NEXT' received e.g. through an ambient noise microphone (not shown) or a microphone of the laptop, tablet or personal computer or smartphone. As a further alternative, the pressure signals provided by the sensors 24,25,26 could be used in the process, recognizing an event of a player stopping blowing and next starting blowing (after a suitable time interval) as a cue to move from learning one musical note to the moving to learning the next musical note.

When the transducer apparatus 20 is then operated in play mode a pre-stored training set is pre-selected. The selection can be made using application software running on a laptop, tablet or personal computer or on a smartphone 45 in communication with the transducer apparatus. Alternatively the transducer apparatus 20 could be provided with manually operable controls to allow the selection. The magnitude spectrum is generated from the measurement signal as above, but instead of being stored as a training set it is compared with each of the spectra in the training set (each stored spectrum in a training set representing a single played note). A variety of techniques may be used for the comparison, e.g. a least squares difference technique or a maximized Pearson second moment of correlation technique. Additionally machine learning techniques may applied to the comparison such that the comparison and or training sets adjusted over time to improve the discrimination between notes.

It is convenient to use only the magnitude spectrum of the measurement signal from a simple understanding and visualization perspective, but the full complex spectrum of both phase and amplitude information (with twice as much data) could also be used, in order to improve the reliability of musical note recognition. However, the use of just the magnitude spectrum has the advantage of speed of processing and transmission, since the magnitude spectrum is about 50% of the data of the full complex spectrum. References to 'spectra' in the specification and claims should be considered as references to: magnitude spectra only; phase spectra only; a combination of phase and amplitude spectra; and/or complex spectra from which magnitude and phase are derivable.

In an alternative embodiment a filter bank, ideally with center frequencies logarithmically spaced, could be used to generate a magnitude spectrum, instead of using a Fast Fourier Transform technique. The center frequencies of the filters in the bank can be selected in order to give improved results, by selecting them to correspond with the frequencies of the musical notes played by the reed instrument.

Thus the outcome of the signal processing is a recognized note, per frame (or chirp) of excitation. The minimum latency is thus the length of the chirp plus the time to generate the spectra and carry out the recognition process against the training set. The processor 41 of the embodiment typically runs at 93 ms for the excitation signal and ~30 ms for the signal processing of the measurement signal. It is desirable to reduce the latency even further; an FFT approach this will typically reduce the spectral resolution since fewer points will be considered, assuming a constant sample rate. With a filter bank approach there will be less processing time available and the filters will have less time to respond, but the spectral resolution need not necessarily be reduced.

The synthesized musical note may be transmitted to be used by application software running on a laptop, tablet or personal computer or smartphone 25 or other connected processor. The connection may be wired or wireless using a variety of connections, e.g. Bluetooth®. A connection could be provided by use of a frequency modulated infra-red LED signal output by the output device 42; the use of such FM optical transmission advantageously reduces transmission delays. Parameters which are not critical to operation but which are useful, e.g. the magnitude spectrum, may also be passed to the application software for every frame. Thus the application software can generate an output on a display screen which allows the player to see a visual effect in the frequency spectrum of playing deficiencies of the player e.g. a failure to totally close a hole. This allows a player to adjust his/her playing and thereby improve his/her skill.

In a further embodiment of the invention an alternate method of excitation signal generation and processing the measurement signal is implemented in which an excitation signal is produced comprising of a rich mixture of frequencies, typically harmonically linked.

The measurement signal is analyzed by a filter-bank or fft to provide a complex frequency spectrum. Then the complex frequency spectrum is run through a recognition algorithm in order to provide a first early indication of the played note. This could be via a variety of recognition techniques including those described above. The first early indication of the played note is then used to dynamically modify the mixture of frequencies of the excitation signal in order to better discriminate the played note. Thus the recognition process is aided by feeding back spectral stimuli which are suited to emphasizing the played note. The stages are repeated on a continuous basis, perhaps even on a sample by sample basis. A recognition algorithm provides the played note as an additional output signal.

In the further embodiment the content of the excitation signal is modified to aid the recognition process. This has parallels with what happens in the conventional playing of a reed instrument in that the reed provides a harmonic rich stimulus which will be modified by the acoustic feedback of the reed instrument, thus reinforcing the production of the played note. However, there are downsides in that a mixture of frequencies as an excitation signal will fundamentally produce a system with a lower signal to noise ratio (SNR) than that using a chirp covering the same frequencies, as described above. This is because the amplitude at any one frequency is necessarily compromised by the other frequencies present if the summed waveform has to occupy the same maximum amplitude. For instance if the excitation signal includes a mixture of 32 equally weighted frequencies, then the overall amplitude of the sum of the frequencies will be 1/32 of that achievable with a scanned chirp over the same frequency range and this will reflect in the SNR of the system. This is why use of an exponential chirp as an excitation signal, as described above, has an inherent superior SNR; but the use of a mixture of frequencies in the excitation signal which is then enhanced might allow the apparatus to have an acceptably low latency between the note being played and the note being recognized by the apparatus.

With suitable communications, application software running on a device external to the instrument and/or the transducer apparatus may also be used to provide a backup/restore facility for the complete set of instrument data, and especially the training sets. The application software may also be used to demonstrate to the user the correct spectrum by displaying the spectrum for the respective note from the training set. The displayed correct spectrum can be displayed alongside the spectrum of the musical note currently played, to allow a comparison.

Since the musical note and its volume are available to the application software per frame, a variety of techniques may be used to present the played note to the player, These include a simple textual description of the note, e.g. G#3, or a (typically a more sophisticated) synthesis of the note providing aural feedback, or a moving music score showing or highlighting the note played, or a MIDI connection to standard music production software e.g. Sibelius, for display of the live note or generation of the score.

The application software running on a laptop, tablet or personal computer 45 or smartphone in communication with the transducer apparatus 20 and/or as part of the overall system of the invention will allow: display on a visual display device of a graphical representation of a frequency of a played note; the selection of a set of data stored in memory for use in the detection of a played note by the apparatus; player control of volume of sound output by the speaker; adjustment of gain of the sensors 24,25,26; adjustment of volume of playback of the synthesized musical note; selection of a training mode or a playing mode operation of the apparatus; selection of a musical note to be learned by the apparatus during the training mode; a visual indication of progress or completion of the learning of a set of musical notes during the training mode; storage in the memory of the laptop, tablet or personal computer or smartphone (or in cloud memory accessed by any of them) of the set of data stored in the on-board memory of the transducer apparatus, which in turn will export (e.g. for restoration purposes) a set of data to the on-board memory 42 of the transducer apparatus 20; a graphical representation, e.g. in alphanumeric characters, of the played note; visual display of musical notes by musical note graphical display of the spectra of the played notes, allowing continuous review by the player; and generation of e.g. pdf files of spectra. The application software could additionally be provided with a feature enabling download and display of musical scores and exercises to help players learning to play an instrument.

Whilst above the identification of a played note and the synthesis of a musical note is carried out by electronics on-board to the transducer apparatus, these processes could be carried out by separate electronics physically distant from but in communication with the apparatus mounted on the instrument or indeed by the application software running on the laptop, tablet or personal computer or smartphone. The generation of the excitation signal could also occur in the separate electronics physically distant from but in communication with the apparatus mounted on the instrument or by the application software running on the laptop, tablet or personal computer 45 or smartphone.

The transducer apparatus 200 may retain in memory 42 the master state of the processing and all parameters, e.g. a chosen training set. Thus the transducer apparatus 200 is programmed to update the process implemented thereby for all parameter changes. In many cases the changes will have been initiated by application software on the laptop, tablet or personal computer or smartphone, e.g. choice of training note. However, the transducer apparatus 200 will also generate changes to state locally, e.g. the pressure currently applied as noted by the sensors 24, 26, 26 or the note currently most recently recognized.

Whilst above an electronic processor 41 is included in the device coupled to the instrument which provides both an excitation signal and outputs a synthesized musical note, a fast communication link between the instrument mounted device and a laptop, tablet or personal computer or smartphone would permit application software on the laptop, tablet or personal computer or smartphone to generate the excitation signal which is then relayed to the speaker mounted on the instrument and to receive the measurement signal from the microphone and detect therefrom the musical note played and to synthesize the musical note played e.g. by a speaker of the laptop, tablet or personal computer or smartphone or relayed to headphones worn by the player. A microphone built into the laptop, tablet or personal computer or smartphone could be used as the ambient noise microphone. The laptop, tablet or personal computer or smartphone would also receive signals from an accelerometer when used.

The synthesized musical notes sent e.g. to headphones worn by a player of the reed instrument could mimic the instrument played or could be musical notes arranged to mimic sounds of a completely different instrument. In this way an experienced player of a reed instrument could by way of the invention play his/her instrument and thereby generate the sound of a e.g. a played guitar. This sound could be heard by the player only by way of headphones or broadcast to an audience via loudspeakers.

In the example of FIGS. 2*a* and 2*b* above the head joint is in its usual position with the embouchure hole 13 on top. The housing 10 with its false lip plate and sensors fits over the real embouchure hole 13. In the embodiment of FIG. 3 the head joint is rotated on its axis so that the embouchure hole 13 is pointing in a different direction and the false lip plate 27 is not immediately above the real one 12. This would mean that the false embouchure hole 29 was not substantially higher than normal, which might be more comfortable for the player. Also the partly covered embouchure hole 13 is directly open to atmosphere and there is no need to include in the housing the passage 30 of FIG. 2*b* to connect the embouchure hole 13 to atmosphere.

In a third possible embodiment the transducer apparatus is built into its own (probably plastic) head joint which slots into the main body of the flute, to temporarily replace the usual head joint of the instrument.

The transducer sensors could be separate from the processor 41, linked by an umbilical.

The false lip plate 27 and airflow sensors 24, 25, 26 could be provided in a "sensor head" assembly separate from a "resonator head" assembly comprising the microphone 23 and speaker 22, with the assemblies linked by an umbilical. This would allow moving of the sensor head closer to the keys 15, effectively shortening the length of the instrument in order to help younger players It would be convenient to be able to select the harmonics manually for testing purposes and also to allow an inexperienced player to exercise the fingerings without blowing into the instrument. That requires a method of selecting the relevant harmonic with a button assembly operated by the right hand thumb of the player and clipped to the body of the flute. Such a button assembly is shown as 50 in FIGS. 2*a* and 2*b*). The buttons would be linked by umbilical or wireless connection to electronic processor 41.

FIG. 5 is a flow chart illustrating the method of operation of the transducer apparatus 20 described above. The flow chart shows one cycle of operation, which will be repeated continuously while the transducer apparatus is in operation.

The box 100 shows the start of the cycle. Initially this will be when the transducer apparatus 20 is activated, for instance by a manually operable on/off switch.

At box 200 the transducer apparatus 20 determines whether it is operating with breath control or whether the player has decided to exercise fingering without blowing the instrument, instead using the button array 50 to select the harmonic to be played, e.g. the octave range of the instrument. The apparatus may be configured with breath control as the default unless there is a button array 50 provided and a button is operated manually by the player, which indicates that player has chosen not to use breath control.

If breath control is selected then at stage 300 the method determines whether the signals provided by the sensors 24, 25, 36 together indicate that the player is playing the instrument, i.e. that the airflow sensed is above a minimum threshold value. If not, then at stage 400 the cycle is stopped, to be restarted at stage 100 for as long as the transducer apparatus is active. When the sensed airflow is above the minimum then at stage 500 the sensed airflow and a volume control operable by the user (e.g. a control provided on the apparatus manually operable by the player or a control provided by software running on the computer 24 or smartphone) are together used to set a volume level for the signal eventually output to the speaker 44 or headphones and/or for the excitation signal output by the speaker 22. A signal from an ambient noise sensor could also be used at this stage in the determination of the volume level.

If breath control is not selected then at stage 600 a volume level is set using a control provided on the apparatus manually operable by the player or a control provided by software running on the computer 24 or smartphone, the volume level being the volume level for the signal eventually output to the speaker 44 or headphones 43 and/or for the excitation signal output by the speaker 22. A signal from an ambient noise sensor could also be used at this stage in the determination of the volume level.

At stage 700 of the method the stimulus signal is initiated and sound delivered by the speaker 22 to the resonant chamber 28, as described above. The frequency spectrum (or other characteristic) of the resulting signal from the microphone 23 is then compared with frequency spectra stored in memory (e.g. learned spectra, as mentioned above) to find a best match and thereby the method determines the note played by the player (i.e. the fingering that has been used by the player). The relevant note frequency F is determined by the processor 41 along with a list of possible harmonics in different octaves: F1, F2 to Fn.

At stage 800 of the method it is determined whether the player is controlling the harmonics to be played with breath control or by use of the button array 50. As a default it could be assumed that breath control is used unless the button array 50 is activated.

If breath control is used then at stage 900 the method compares the output signals of the sensors 24, 25, 26 with each other to thereby determine which harmonic to select as the harmonic played by the instrument.

If breath control is not used then at stage 1000 of the method the processor 41 determines which buttons (e.g. B1, B2 to Bn) of the button array 50 are selected by the player to thereby determine which harmonic has been selected.

At method stage 1100, the musical tone determined by the earlier method stages is output by output device at a frequency Fn and at the set volume (see boxes 500 and 600) to be delivered as a sound by headphones 43 and/or speaker 44. Also the musical tone is output to the computer 45 (or smartphone) to be visually displayed.

At method stage 1200 the cycle stops to be started again at 100 while the transducer apparatus 20 remains active.

Whilst above the transducer apparatus has been described as having both a set of breath sensors 24, 25 and 26 and an array of buttons 50, it is possible for the transducer apparatus to have only the set of breath sensors 24, 25 and 26 or the array of buttons 50.

If the transducer apparatus is provided with only a set of breath sensors 24, 25 and 26 then the method stages 200, 600 and 800 above can be dispensed with and also method stage 1000; i.e. the player would always use breath and airjet control. The transducer apparatus 20 would still include an aerophone speaker which outputs an excitation signal and an aerophone microphone which produces a signal from which the transfer function of the resonant chamber can be determined, as described above.

If the transducer apparatus is to be operated always with use of the array of buttons 50, then it could be provided with a single simple breath sensor which gives a signal indicating when breath is applied and optionally the strength of the applied breadth; this would still allow the method stages 200, 300, 400 and 500 of the method described above, except that a single breath signal would be used instead of an aggregate of the signals of a plurality of breath sensors. The method stages 800 and 900 would be eliminated and method stage 1000 always implemented to determine the harmonic to be used. A further simplified version of a transducer apparatus of the invention could dispense with breath sensors altogether, eliminating the stages 200, 300, 400, 500, 800 and 900 described above, with the method always implementing the stage 1000 to determine the harmonic to be used and the (optional) stage 600 to determine the output volume. The transducer apparatus would still include an aerophone speaker which outputs an excitation signal and an aerophone microphone which produces a signal from which the transfer function of the resonant chamber can be determined, as described above.

Above there has been mentioned the use of an ambient microphone placed outside but close to the instrument. An alternative way of sensing ambient noise would be to use the instrument microphone 23, by controlling operation of the speaker 22 to have a period of silence e.g. along with the chirp. During the silence the output of the microphone 23 would be used by the processor to analyses ambient noise.

The processor 41 would then modify the chirp response received from the microphone 23 in the light of the ambient noise.

The invention claimed is:

1. A transducer apparatus for an edge-blown aerophone, the edge-blown aerophone having an aerophone embouchure hole and a resonant chamber, the transducer apparatus comprising:

an aerophone speaker configured to deliver a sound signal to the resonant chamber of the aerophone via the aerophone embouchure hole;

an aerophone microphone configured to receive, via the aerophone embouchure hole, sound in the resonant chamber;

a housing including a lip plate with a housing embouchure hole that is independent and separate from the aerophone embouchure hole, wherein the housing further comprises a plurality of sensor passages and a plurality of respective breath outlets, each sensor passage connecting the housing embouchure hole to a respective breath outlet provided by the housing;

at least one breath sensor configured to sense breath applied across the housing embouchure hole; and an electronic processor configured to receive signals from the microphone and from the breath sensor, the electronic processor being connected to the speaker, wherein the breath sensor is one of a plurality of breath sensors, each one of the plurality of breath sensors being located in a respective sensor passage, wherein the electronic processor is configured to receive signals from each of the breath sensors, and wherein during use of the apparatus:

the breath sensor provides a signal indicative of breath strength to the electronic processor;

the electronic processor generates an excitation signal which is delivered as an acoustic excitation signal to the resonant chamber by the aerophone speaker;

the electronic processor uses the signals received by the processor to determine a desired musical note which a player of the aerophone wishes to play;

the electronic processor synthesizes the desired musical note and outputs the synthesized note to one of more of headphones, a speaker external to the transducer apparatus, a computer apparatus and/or a smartphone, whereby the musical note is played audibly and/or displayed visually to the player;

the sensor passages direct breath of the player from the independent housing embouchure hole to the breath outlets; and the breath sensors provide signals to the electronic processor, the signals indicative of breath strength in each of the sensor passages.

2. The transducer apparatus of claim 1, wherein the electronic processor, when determining the desired musical note, uses the breath sensor signals to determine a strength and direction of the breath of the player.

3. The transducer apparatus of claim 1, further comprising at least three sensor passages that are independent from each other, each having a respective breath sensor.

4. The transducer apparatus of claim 1, wherein the aerophone speaker and the aerophone microphone are provided in a common housing releasably attachable to the aerophone, and wherein the aerophone speaker and the aerophone microphone are configured to be located in or adjacent to the aerophone embouchure hole while leaving the aerophone embouchure hole partly uncovered.

5. The transducer apparatus of claim 4, wherein the housing further comprises a vent passage via which the partly uncovered embouchure hole is linked to atmosphere.

6. The transducer apparatus of claim 4, wherein the common housing for the aerophone speaker and the aerophone microphone is also the housing which provides the lip plate with the housing embouchure hole.

7. The transducer apparatus of claim 6, further comprising a power source for the electronic processor, wherein the electronic processor is provided in the common housing for the aerophone speaker and the aerophone microphone along with the power source for the electronic processor.

8. The transducer apparatus of claim 4, wherein the common housing for the aerophone speaker and the aerophone microphone is independent from the housing which provides the lip plate, the housing embouchure hole, and the sensor passages.

9. The transducer apparatus of claim 1, further comprising one or more electric or electronic buttons mounted on the aerophone which are configured to be in communication with the electronic processor and which enable a player to select a harmonic to be generated by the transducer apparatus.

10. The transducer apparatus of claim 1, further comprising a memory device, wherein the electronic processor uses the received signals to determine a desired musical note which a player of the aerophone wishes to play by a process which includes comparing the aerophone microphone signal or a frequency spectrum thereof to pre-stored signals or spectra held in the memory device of the transducer apparatus to thereby determine a match.

11. The transducer apparatus of claim 10, wherein:

the excitation signal includes a plurality of tone fragments corresponding to musical notes that can be played by the aerophone, the tone fragments being arranged in an ordered set by the processor to form a stimulus-frame, and the electronic processor is configured to process the aerophone microphone signal to provide a set of measurements at known frequencies which are then compared with sets of values held in the memory device to determine the match.

12. The transducer apparatus of claim 11, wherein the excitation signal is an exponential chirp, and wherein the electronic processor is configured to process the aerophone microphone signal to provide the frequency spectrum thereof, and to compare the frequency spectrum to sets of frequency spectra held in the memory device to determine the match.

13. The transducer apparatus of claim 11, further comprising a filter bank that is configured to generate a magnitude spectrum from the aerophone microphone signal.

14. The transducer apparatus of claim 11, wherein the processor is configured to implement a cycle in which a first excitation signal is produced that includes a first mixture of frequencies, then a frequency spectrum of the resulting aerophone microphone signal is analyzed by the processor to give a first indication of the played musical note, next the processor adapts the first mixture of frequencies of the excitation signal based on the first indication of the played musical note to thereby produce a second adapted excitation signal for a second mixture of frequencies, then the processor outputs the second adapted excitation signal and the resulting aerophone microphone signal is analysed by the processor to give a second indication of the played musical note which is used by the processor to determine the musical note to be synthesized.

15. The transducer apparatus of claim 11, further comprising:

a computer apparatus and/or a smartphone which is configured to receive the output synthesized musical note, wherein the computer apparatus and/or the smartphone is configured to control one or more of:

a display of a graphical representation of a frequency of a played note;

a visual indication of progress or completion of learning of a set of musical notes during a training mode in which signals or spectra are held in the memory unit;

storage, in a memory device of the computer apparatus or smartphone, of the set(s) of data stored in the memory device of the transducer apparatus;

a graphical representation in alphanumeric characters of a played note;

a visual display of a played musical note by of the spectrum of the played note; and a download and display of musical scores.

16. The transducer apparatus of claim 11, further comprising a computer apparatus and/or a smartphone which is configured to receive the output synthesized musical note, wherein the computer apparatus and/or the smartphone is configured to send control signals to the transducer apparatus and to thereby allow a user to control one or more of:

a selection of a set of data stored in the memory device for use in the detection of a played note by the transducer apparatus;

control of a volume of sound output by the speaker;

adjustment of a gain of the breath sensor(s);

adjustment of a volume of playback of the synthesized musical note;

selection of a training mode or a playing mode operation of the transducer apparatus; and selection of a musical note whose spectrum is to be stored in the memory device during a training mode of the transducer apparatus.

17. A transducer apparatus for an edge-blown aerophone, the edge-blown aerophone having a removable head joint having an aerophone embouchure hole, the transducer apparatus comprising:

a transducer head joint which is configured to be connected to the aerophone in place of an existing head joint thereof, the transducer head joint having a housing which provides a lip plate and a housing embouchure hole, wherein the housing further comprises a plurality of sensor passages, a plurality of breath sensors, and a plurality of respective breath outlets, each sensor passage connecting the housing embouchure hole to a respective breath outlet provided by the housing;

an aerophone speaker mounted on the housing, the aerophone speaker configured to deliver a sound signal to a resonant chamber of the aerophone via the housing embouchure hole;

an aerophone microphone mounted on the housing, the aerophone microphone configured to receive, via the housing embouchure hole, sound in the resonant chamber;

at least one breath sensor configured to sense breath applied across the housing embouchure hole; and an electronic processor configured to receive signals from the microphone and the breath sensor, the electronic processor being connected to the speaker, wherein the breath sensor is one of the plurality of breath sensors, each one of the plurality of breath sensors being located in a respective sensor passage, wherein the electronic processor is configured to receive signals from each of the breath sensors, and wherein during use of the apparatus:

the breath sensor provides a signal indicative of breath strength to the electronic processor;

the electronic processor generates an excitation signal which is delivered as an acoustic excitation signal to the resonant chamber by the aerophone speaker;

the electronic processor uses the signals received by the processor to determine a desired musical note which a player of the aerophone wishes to play;

the electronic processor synthesizes the desired musical note and outputs the synthesized note to one of more of headphones, a speaker external to the transducer apparatus, a computer apparatus and/or a smartphone, whereby the musical note is played audibly and/or displayed visually to the player;

the sensor passages direct breath of the player from the independent housing embouchure hole to the breath outlets; and the breath sensors provide signals to the electronic processor, the signals indicative of breath strength in each of the sensor passages.

18. The transducer apparatus of claim 17, wherein the electronic processor, when determining the desired musical note, uses the breath sensor signals to determine a strength and direction of the breath of the player.

19. The transducer apparatus of claim 17, further comprising at least three sensor passages that are independent from each other, each having a respective breath sensor.

20. A transducer apparatus for an edge-blown aerophone, the edge-blown aerophone having an aerophone embouchure hole and a resonant chamber, the transducer apparatus comprising:

an aerophone speaker configured to deliver a sound signal to the resonant chamber of the aerophone via the aerophone embouchure hole;

an aerophone microphone configured to receive, via the aerophone embouchure hole, sound in the resonant chamber;

a housing including a lip plate with a housing embouchure hole that is independent and separate from the aerophone embouchure hole, wherein the housing further comprises a plurality of sensor passages, a plurality of breath sensors, and a plurality of respective breath outlets, each sensor passage connecting the housing embouchure hole to a respective breath outlet provided by the housing;

an electronic processor configured to receive signals from the microphone, the electronic processor being connected to the speaker; and one or more electric or electronic buttons mounted on the aerophone which are configured to be in communication with and can send signals to the electronic processor to thereby enable a player to select a harmonic to be generated by the transducer apparatus, wherein the electronic processor is configured to receive signals from each of the breath sensors, and wherein during use of the apparatus:

the electronic processor generates an excitation signal which is delivered as an acoustic excitation signal to the resonant chamber by the aerophone speaker;

the electronic processor uses the signals received from the microphone and the button(s) to determine a desired musical note which a player of the aerophone wishes to play;

the electronic processor synthesizes the desired musical note and outputs the synthesized note to one of more of headphones, a speaker external to the transducer apparatus, a computer apparatus and/or a smartphone, whereby the musical note is played audibly and/or displayed visually to the player;

the sensor passages direct breath of the player from the independent housing embouchure hole to the breath outlets; and the breath sensors provide signals to the electronic processor, the signals indicative of breath strength in each of the sensor passages.

21. The transducer apparatus of claim 20, wherein the electronic processor is configured to use the received signals to control one or more of a timing and a volume of the output synthesized note.

22. A transducer apparatus for an edge-blown aerophone, the edge-blown aerophone having a removable head joint having an aerophone embouchure hole, the transducer apparatus comprising:

a resonant chamber;

a transducer head joint which is configured to be connected to the aerophone in place of an existing head joint thereof, the transducer head joint having a housing which provides a lip plate and a housing embouchure hole, wherein the housing further comprises a plurality of sensor passages, a plurality of breath sensors, and a plurality of respective breath outlets, each sensor passage connecting the housing embouchure hole to a respective breath outlet provided by the housing;

an aerophone speaker mounted on the housing, the aerophone speaker configured to deliver a sound signal to the resonant chamber of the aerophone via the housing embouchure hole;

an aerophone microphone mounted on the housing, the aerophone microphone configured to receive, via the housing embouchure hole, sound in the resonant chamber;

an electronic processor configured to receive signals from the microphone, the electronic processor being connected to the speaker; and one or more electric or electronic buttons mounted on the aerophone which are configured to be in communication with and to send signals to the electronic processor to thereby enable a player to select a harmonic to be generated by the transducer apparatus, wherein the electronic processor is configured to receive signals from each of the breath sensors, and wherein during use of the apparatus:

the electronic processor generates an excitation signal which is delivered as an acoustic excitation signal to the resonant chamber by the aerophone speaker;

the electronic processor uses the signals received from the microphone and the button(s) to determine a desired musical note which a player of the aerophone wishes to play;

the electronic processor synthesizes the desired musical note and outputs the synthesized note to one of more of headphones, a speaker external to the transducer apparatus, a computer apparatus and/or a smartphone, whereby the musical note is played audibly and/or displayed visually to the player;

the sensor passages direct breath of the player from the independent housing embouchure hole to the breath outlets; and the breath sensors provide signals to the electronic processor, the signals indicative of breath strength in each of the sensor passages.

23. The transducer apparatus of claim 22, further comprising at least one breath sensor configured to sense breath applied across the housing embouchure hole, wherein the electronic processor receives signals from the breath sensor and uses the received signals to control one or more of a timing and a volume of the output synthesized note.

24. An edge-blown aerophone comprising a transducer apparatus, the edge-blown aerophone having an aerophone embouchure hole and a resonant chamber, the transducer apparatus comprising:

an aerophone speaker configured to deliver a sound signal to the resonant chamber of the aerophone via the aerophone embouchure hole;

an aerophone microphone configured to receive, via the aerophone embouchure hole, sound in the resonant chamber;

a housing including a lip plate with a housing embouchure hole that is independent and separate from the aerophone embouchure hole, wherein the housing further comprises a plurality of sensor passages and a plurality of respective breath outlets, each sensor passage connecting the housing embouchure hole to a respective breath outlet provided by the housing;

at least one breath sensor configured to sense breath applied across the housing embouchure hole; and an electronic processor configured to receive signals from the microphone and from the breath sensor, the electronic processor being connected to the speaker, wherein the breath sensor is one of a plurality of breath sensors, each one of the plurality of breath sensors being located in a respective sensor passage, wherein the electronic processor is configured to receive signals from each of the breath sensors, and wherein during use of the apparatus:

the breath sensor provides a signal indicative of breath strength to the electronic processor;

the electronic processor generates an excitation signal which is delivered as an acoustic excitation signal to the resonant chamber by the aerophone speaker;

the electronic processor uses the signals received by the processor to determine a desired musical note which a player of the aerophone wishes to play;

the electronic processor synthesizes the desired musical note and outputs the synthesized note to one of more of headphones, a speaker external to the transducer apparatus, a computer apparatus and/or a smartphone, whereby the musical note is played audibly and/or displayed visually to the player;

the sensor passages direct breath of the player from the independent housing embouchure hole to the breath outlets; and the breath sensors provide signals to the electronic processor, the signals indicative of breath strength in each of the sensor passages.

* * * * *